US010422349B2

(12) United States Patent
Matsui et al.

(10) Patent No.: US 10,422,349 B2
(45) Date of Patent: Sep. 24, 2019

(54) PROPELLER FAN AND BLOWER UNIT

(71) Applicant: DAIKIN INDUSTRIES, LTD., Osaka-shi, Osaka (JP)

(72) Inventors: Kazuyasu Matsui, Osaka (JP); Shimei Tei, Osaka (JP); Tooru Iwata, Osaka (JP); Shigeyuki Takaoka, Osaka (JP)

(73) Assignee: DAIKIN INDUSTRIES, LTD., Osaka-shi (JP)

( * ) Notice: Subject to any disclaimer, the term of this patent is extended or adjusted under 35 U.S.C. 154(b) by 308 days.

(21) Appl. No.: 15/324,338

(22) PCT Filed: Jul. 3, 2015

(86) PCT No.: PCT/JP2015/003370
§ 371 (c)(1),
(2) Date: Jan. 6, 2017

(87) PCT Pub. No.: WO2016/006217
PCT Pub. Date: Jan. 14, 2016

(65) Prior Publication Data

US 2017/0184125 A1 Jun. 29, 2017

(30) Foreign Application Priority Data

Jul. 8, 2014 (JP) ..... 2014-140542
Jul. 8, 2014 (JP) ..... 2014-140545

(51) Int. Cl.
*F04D 29/54* (2006.01)
*F04D 29/38* (2006.01)
(Continued)

(52) U.S. Cl.
CPC ..... *F04D 29/542* (2013.01); *F04D 19/002* (2013.01); *F04D 29/164* (2013.01);
(Continued)

(58) Field of Classification Search
CPC .... F04D 29/542; F04D 29/164; F04D 29/661; F04D 29/544; F04D 29/384;
(Continued)

(56) References Cited

U.S. PATENT DOCUMENTS 4,664,593 A 5/1987 Hayashi et al.
5,215,441 A 6/1993 Evans et al.
(Continued)

FOREIGN PATENT DOCUMENTS

CN 102865237 A 1/2013
DE 102007012790 * 9/2008
(Continued)

OTHER PUBLICATIONS

International Search Repot, issued in PCT/JP2015/003370 (PCT/ISA/210), dated Sep. 15, 2015.

*Primary Examiner* — Jacob M Amick
*Assistant Examiner* — Charles Brauch
(74) *Attorney, Agent, or Firm* — Birch, Stewart, Kolasch & Birch, LLP

(57) ABSTRACT

A propeller fan includes a rotary blade hub driven in rotation about a rotation axis, and a rotary blade installed at an outer periphery of the rotary blade hub. The rotary blade includes a rotary blade body protruding from an outer peripheral surface of the rotary blade hub, and a rib formed on an outer peripheral edge portion of a pressure surface of the rotary blade body so as to extend along an outer peripheral edge of the rotary blade body.

12 Claims, 13 Drawing Sheets

(51) Int. Cl.

| | |
|---|---|
| ***F24F 1/00*** | (2019.01) |
| ***F04D 19/00*** | (2006.01) |
| ***F04D 29/66*** | (2006.01) |
| ***F24F 1/0029*** | (2019.01) |
| ***F04D 29/16*** | (2006.01) |

(52) U.S. Cl.

CPC ..... *F04D 29/38* (2013.01); *F04D 29/384* (2013.01); *F04D 29/544* (2013.01); *F04D 29/661* (2013.01); *F24F 1/00* (2013.01); *F24F 1/0029* (2013.01); *F05D 2240/122* (2013.01); *F05D 2240/125* (2013.01); *F05D 2240/305* (2013.01); *F05D 2240/307* (2013.01)

(58) Field of Classification Search

CPC ..... F04D 19/002; F04D 29/38; F24F 1/0029; F24F 1/00; F05D 2240/307; F05D 2240/122; F05D 2240/305; F05D 2240/125

See application file for complete search history.

(56) References Cited

U.S. PATENT DOCUMENTS

| | | | | |
|---|---|---|---|---|
| 2003/0095864 | A1 | 5/2003 | Ivanovic | |
| 2009/0110551 | A1* | 4/2009 | Yoshida | F04D 25/0613 415/208.2 |
| 2012/0093635 | A1 | 4/2012 | Yoshida et al. | |

FOREIGN PATENT DOCUMENTS

| | | | | | |
|---|---|---|---|---|---|
| DE | 102007012790 | A1 | * | 9/2008 | B01F 3/04049 |
| EP | 2242932 | B1 | | 7/2017 | |
| GB | 2452104 | A | | 2/2009 | |
| JP | 2000-314394 | A | | 11/2000 | |
| JP | 2012-241664 | A | | 11/2000 | |
| JP | 2000314394 | A | * | 11/2000 | |
| JP | 2003-254659 | A | | 9/2003 | |
| JP | 2009-108792 | A | | 5/2009 | |
| JP | 2013-96307 | A | | 5/2013 | |
| JP | 201396307 | A | * | 5/2013 | |

* cited by examiner

PROPELLER FAN AND BLOWER UNIT

TECHNICAL FIELD

This disclosure relates to a propeller fan and a blower unit including the propeller fan.

BACKGROUND ART

Propeller fans blowing air in an axial direction have been used in various technical fields. Moreover, providing a static blade straightening an airflow blown by the propeller fan for a fan housing, which houses such a propeller fan, is known in the art. For example, Cited Reference 1 discloses a fan unit including a propeller fan and a diffuser, which converts kinetic energy of air blown out of the propeller fan into pressure energy. Note that this diffuser includes an exterior and an interior shroud, each having a cylindrical shape, and a plurality of static blades installed between the exterior and interior shrouds.

CITATION LIST

Patent Documents

PATENT DOCUMENT 1: Japanese Unexamined Patent Publication No. 2003-254659

SUMMARY OF THE INVENTION

Technical Problem

In the fan unit of Cited Reference 1, air sucked into the propeller fan travels along a pressure surface of a rotary blade from a leading edge side toward a rear edge side. At the same time, centrifugal force generated by rotation of the propeller fan makes the air travel from an inner peripheral side of the rotary blade toward an outer peripheral side. Thus, at an outer peripheral edge portion of the rotary blade, air, which has traveled along the pressure surface of the rotary blade toward the outer peripheral edge portion, is at risk to travel beyond an outer peripheral edge of the rotary blade and to flow back to a suction surface side. As can be seen, if at the outer peripheral edge portion of the rotary blade an airflow from the pressure surface side toward the suction surface side occurs, the amount of air blown out of the propeller fan toward a leeward side decreases thus reducing the air blow efficiency of the fan.

In view of this, the present disclosure provides a propeller fan and a blower unit, which may enhance the air blow efficiency.

Solution to the Problem

A first aspect of this disclosure is directed at a propeller fan (50) blowing air in an axial direction of a rotation axis (O) and including a rotary blade hub (51) driven in rotation about the rotation axis (O), and a rotary blade (52) located at an outer periphery of the rotary blade hub (51), wherein the rotary blade (52) includes a rotary blade body (52*a*) protruding from an outer peripheral surface of the rotary blade hub (51), and a rib (52*b*) formed on an outer peripheral edge portion of a pressure surface of the rotary blade body (52*a*) so as to extend along an outer peripheral edge of the rotary blade body (52*a*).

In the first aspect, air sucked into the propeller fan (50) travels along the pressure surface of the rotary blade body (52*a*) from a leading edge side toward a rear edge side. At the same time, centrifugal force generated by rotation of the propeller fan (50) makes the air travel from an inner peripheral side of the rotary blade body (52*a*) toward an outer peripheral side. Having traveled along the pressure surface of the rotary blade body (52*a*) toward the outer peripheral edge portion of the rotary blade body (52*a*), the air impacts on the rib (52*b*) and is lead along the rib (52*b*) toward the leeward side. This may reduce the risk of air, which has traveled along the pressure surface of the rotary blade body (52*a*) toward the outer peripheral edge portion of the rotary blade body (52*a*), traveling beyond the outer peripheral edge of the rotary blade body (52*a*) and flowing back toward a suction surface side.

A second aspect of this disclosure relates to the propeller fan of the first aspect. The rotary blade body (52*a*) may have an outer peripheral surface of a cylindrical shape, and the rib (52*b*) may have an outer peripheral surface of a cylindrical shape flush with the outer peripheral surface of the rotary blade body (52*a*).

In the second aspect, the outer peripheral surface of the rotary blade body (52*a*) and the outer peripheral surface of the rib (52*b*) form an outer peripheral surface of the rotary blade (52). Note that, generally, a member (e.g., a bell mouth or a fan housing) enclosing an outer periphery of the propeller fan (50) has an inner peripheral surface of a cylindrical shape enclosing the rotation axis (O). Therefore, forming the outer peripheral surface of the rotary blade (52) in a cylindrical shape (i.e., a shape corresponding to the inner peripheral surface of the member enclosing the outer periphery of the propeller fan (50)) allows to narrow a gap (hereinafter "rotary blade gap") between the outer peripheral surface of the rotary blade (52) and the inner peripheral surface of the member enclosing the outer periphery of the propeller fan (50). This may reduce the risk of air, which has traveled along the pressure surface of the rotary blade body (52*a*) toward the outer peripheral edge portion of the rotary blade body (52*a*), passing through the rotary blade gap and flowing back to the suction surface side.

A third aspect of this disclosure relates to the propeller fan of the first or second aspect. The rib (52*b*) may have an inner peripheral surface formed so as to stand upright with respect to the pressure surface of the rotary blade body (52*a*).

In the third aspect, at the outer peripheral edge portion of the pressure surface of the rotary blade body (52*a*), airflow from the inner peripheral side toward the outer peripheral side may be reliably obstructed. This may reliably reduce the risk of air flowing from a pressure surface side to a suction surface side at the outer peripheral edge portion of the rotary blade (52).

A fourth aspect of this disclosure relates to the propeller fan of any one of the first to third aspects. The rib (52*b*) may have a height (H) increasing from the leading edge side toward the rear edge side of the rotary blade body (52*a*).

In the fourth aspect, air travels toward the outer peripheral edge portion of the rotary blade (52) at a velocity increasing from a leading edge side toward a rear edge side of the outer peripheral edge portion of the rotary blade (52). Therefore, at the outer peripheral edge portion of the rotary blade (52), the risk of air flowing from the pressure surface side to the suction surface side of the rotary blade (52) increases from the leading edge side toward the rear edge side. Thus, forming the rib (52*b*) such that the height (H) increases from the leading edge side toward the rear edge side of the rotary blade body (52*a*), may effectively decrease the risk of air flowing back from the pressure surface side to the suction surface side of the outer peripheral edge portion of the rotary blade (52).

A fifth aspect of this disclosure relates to a blower unit including a propeller fan (50) sending air in an axial direction of a rotation axis (O), and a fan housing (60) housing the propeller fan (50) in a rotatable manner, wherein the fan housing (60) is installed so as to enclose the outer periphery of the propeller fan (50) and having a housing body (61) allowing air sent by the propeller fan (50) to an interior space of the housing body (61) to pass through, and a static blade (62) provided for an inner periphery of the housing body (61) to be located at a leeward side of the propeller fan (50) and straightening air blown out of the propeller fan (50), and the propeller fan (50) is a propeller fan (50) of any one of the first to fourth aspects.

In the fifth aspect, an airflow blown by the propeller fan (50) may be straightened. This allows to convert dynamic pressure (kinetic energy) of the air blown out of the propeller fan (50) into static pressure (pressure energy).

A sixth aspect of this disclosure relates to the blower unit of the fifth aspect. The static blade (62) may have a notch (62*a*) formed on an outer peripheral side of a rear edge portion of the static blade (62).

In the sixth aspect, air blown out of the propeller fan (50) swirls in a circumferential direction while spreading from an inner peripheral side toward an outer peripheral side due to torque generated by the propeller fan (50), and proceeds in the axial direction from a windward side toward the leeward side. Therefore, in the fan housing (60), wind velocity is higher at an outer peripheral side of a pressure surface of the static blade (62) than at an inner peripheral side. That is, air traveling toward the outer peripheral side of the rear edge portion of the static blade (62) travels at a higher velocity than air traveling toward an inner peripheral side of the rear edge portion of the static blade (62). Thus, in the case where no notch (62*a*) is formed in the static blade (62), a Kármán vortex may easily form at the outer peripheral side of the rear edge portion of the static blade (62).

Note that in the sixth aspect, the notch (62*a*) is formed at an outer peripheral side of a rear edge side of the static blade (62). Having traveled to the outer peripheral side of the rear edge portion of the static blade (62), the air thus passes through the notch (62*a*) formed on the outer peripheral side of the rear edge portion of the static blade (62). In this way, at the outer peripheral side of the rear edge portion of the static blade (62), a collision of air against the static blade (62) may be avoided. Therefore, the risk of a Kármán vortex forming at the outer peripheral side of the rear edge portion of the static blade (62) may be reduced.

A seventh aspect of this disclosure relates to the blower unit of the sixth aspect. The static blade (62) may have a chamfered corner (62*b*) adjacent to an inner peripheral side of the notch (62*a*).

In the seventh aspect, chamfering the corner (62*b*) of the static blade (62) may allow to smooth an airflow at the corner (62*b*) of the static blade (62). Therefore, the risk of a Kármán vortex forming at the corner (62*b*) of the static blade (62) may be reduced.

An eighth aspect of this disclosure relates to the blower unit of the sixth or seventh aspect. The notch (62*a*) may be formed so as to become deeper from the inner peripheral side to the outer peripheral side of the static blade (62).

In the eighth aspect, at the outer peripheral side of the rear edge side of the static blade (62), the velocity of the air traveling toward the rear edge portion of the static blade (62) becomes higher from the inner peripheral side to the outer peripheral side. Therefore, the risk of a Kármán vortex forming at the outer peripheral side of the rear edge portion of the static blade (62) increases from the inner peripheral side toward the outer peripheral side. Thus, the notch (62*a*) being formed so as to become deeper from the inner peripheral sidetoward the outer peripheral side of the static blade (62) may effectively reduce the risk of a Kármán vortex forming at the outer peripheral side of the rear edge portion of the static blade (62).

A ninth aspect of this disclosure relates to the blower unit of any one of the sixth to eighth aspects. The housing body (61) may have a portion enclosing the outer periphery of the propeller fan (50) formed integrally with a portion enclosing an outer periphery of the static blade (62).

In the ninth aspect, constructing the housing body (61) such that the portion enclosing the outer periphery of the propeller fan (50) is formed integrally with the portion enclosing the outer periphery of the static blade (62) may allow to reduce the risk of air leakage at the housing body (61).

Advantages of the Invention

According to the first aspect, at the outer peripheral edge of the rotary blade (52), the risk of air flowing back from the pressure surface side to the suction surface side may be reduced. This reduces the risk of a decrease in the amount of air blown by the propeller fan (50) toward the leeward side. In this way, the air blow efficiency of the propeller fan (50) may be improved.

According to the second aspect, the risk of air flowing back from the pressure surface side toward the suction surface side of the rotary blade (52) via the rotary blade gap (i.e., the gap between the outer peripheral surface of the rotary blade (52) and the inner peripheral surface of the member enclosing the outer periphery of the propeller fan (50)) may be reduced. Thus, the air blow efficiency of the propeller fan (50) may be improved.

According to the third aspect, at the outer peripheral edge portion of the rotary blade (52), the risk of air flowing back from the pressure surface side to the suction surface side may be reliably reduced. This may reliably improve the air blow efficiency of the propeller fan (50).

According to the fourth aspect, at the outer peripheral edge portion of the rotary blade (52), the risk of air flowing back from the pressure surface side toward the suction surface side may be effectively reduced. This may improve the air blow efficiency of the propeller fan (50).

According to the fifth aspect, dynamic pressure of air blown out of the propeller fan (50) may be converted into static pressure. This may increase static pressure at a leeward side of a blower unit (40).

According to the sixth aspect, the risk of a Kármán vortex forming at the outer peripheral side of the rear edge portion of the static blade (62) may be reduced. This may reduce the risk of a decrease in the amount of air blown out from the static blade (62) toward the leeward side. This, again, may reduce the risk of the air blow efficiency at the fan housing (60) decreasing, and may, as a result, improve the air blow efficiency of the blower unit (40).

According to the seventh aspect, the risk of a Kármán vortex forming at the corner (62*b*) of the static blade (62)

may be reduced. This may reduce the risk of a decrease in the air blow efficiency at the fan housing (60).

According to the eighth aspect, the risk of a Kármán vortex forming at the outer peripheral side of the rear edge portion of the static blade (62) may be effectively reduced. This may effectively reduce the risk of a decrease in the air blow efficiency at the fan housing (60).

According to the ninth aspect, the risk of air leakage at the housing body (61) may be reduced. This may reduce the risk of a decrease in the air blow efficiency at the fan housing (60).

DESCRIPTION OF EMBODIMENTS

Figure 1:
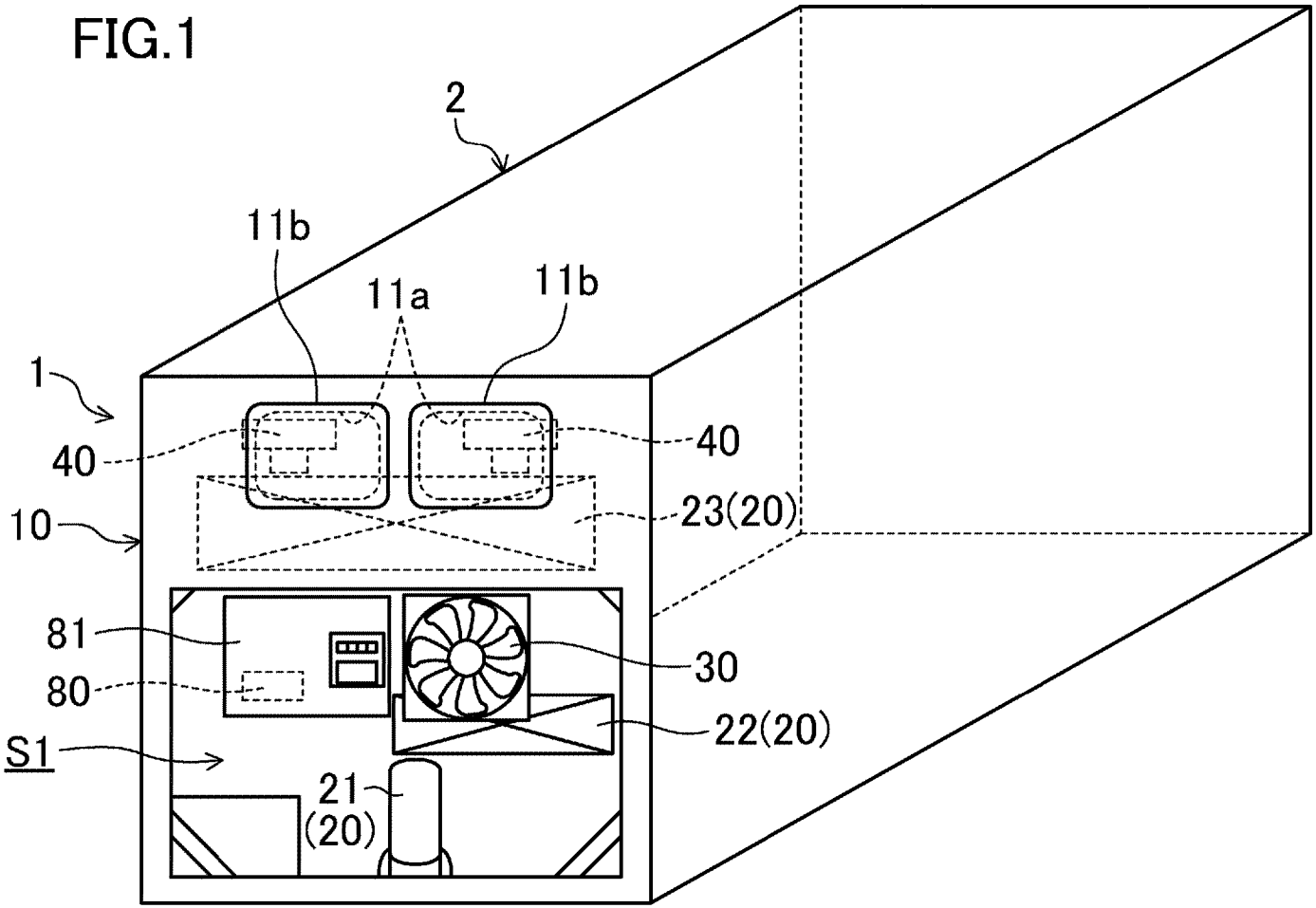
FIG. 1 is a perspective view illustrating a structure of a container refrigeration device.

In the following, embodiments are described in detail with reference to the drawings. Note that, in the drawings, the same or equivalent parts are identified with the same reference characters and will not be repeatedly explained.

[Container Refrigeration Device]

FIG. 1 shows an example construction of a container refrigeration device (hereinafter simply "refrigeration device (1)"). The refrigeration device (1) is installed in a container (2) used for shipping or other forms of transportation, and cools air inside the container (2). The refrigeration device (1) includes a casing (10), a refrigeration circuit (20), an exterior blower unit (30), an interior blower unit (40), and a controller (80). In this example, the container (2) has the shape of a rectangular box having one open side in a longitudinal direction. The refrigeration device (1) is installed at one end (the open end) of the container (2) so as to close the open side of the container (2). Note that FIG. 1 is a perspective view showing the refrigeration device (1) when viewed from outside the container (2).

〈Casing〉

Figure 2:
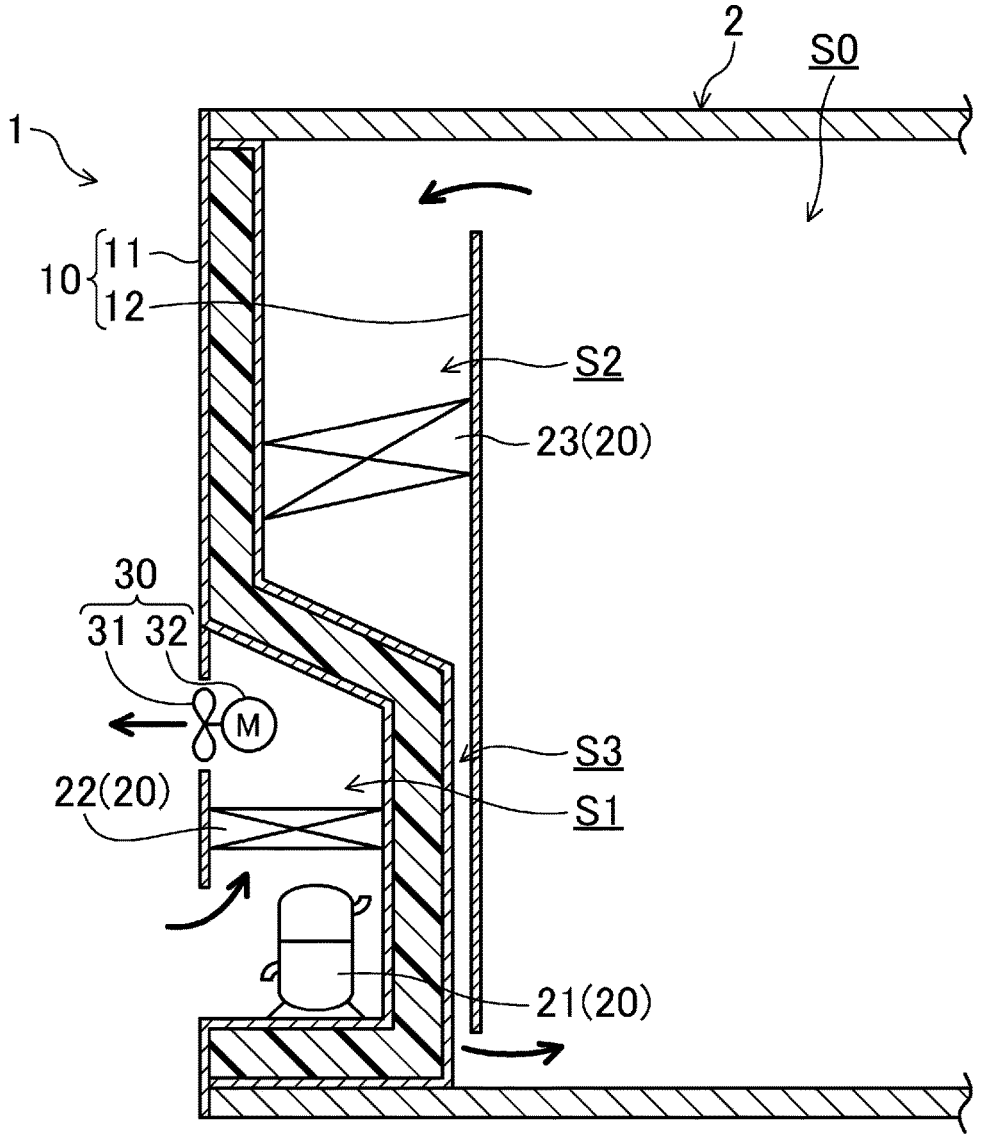
FIG. 2 is a cross-sectional view illustrating a configuration of the container refrigeration device.
Figure 3:
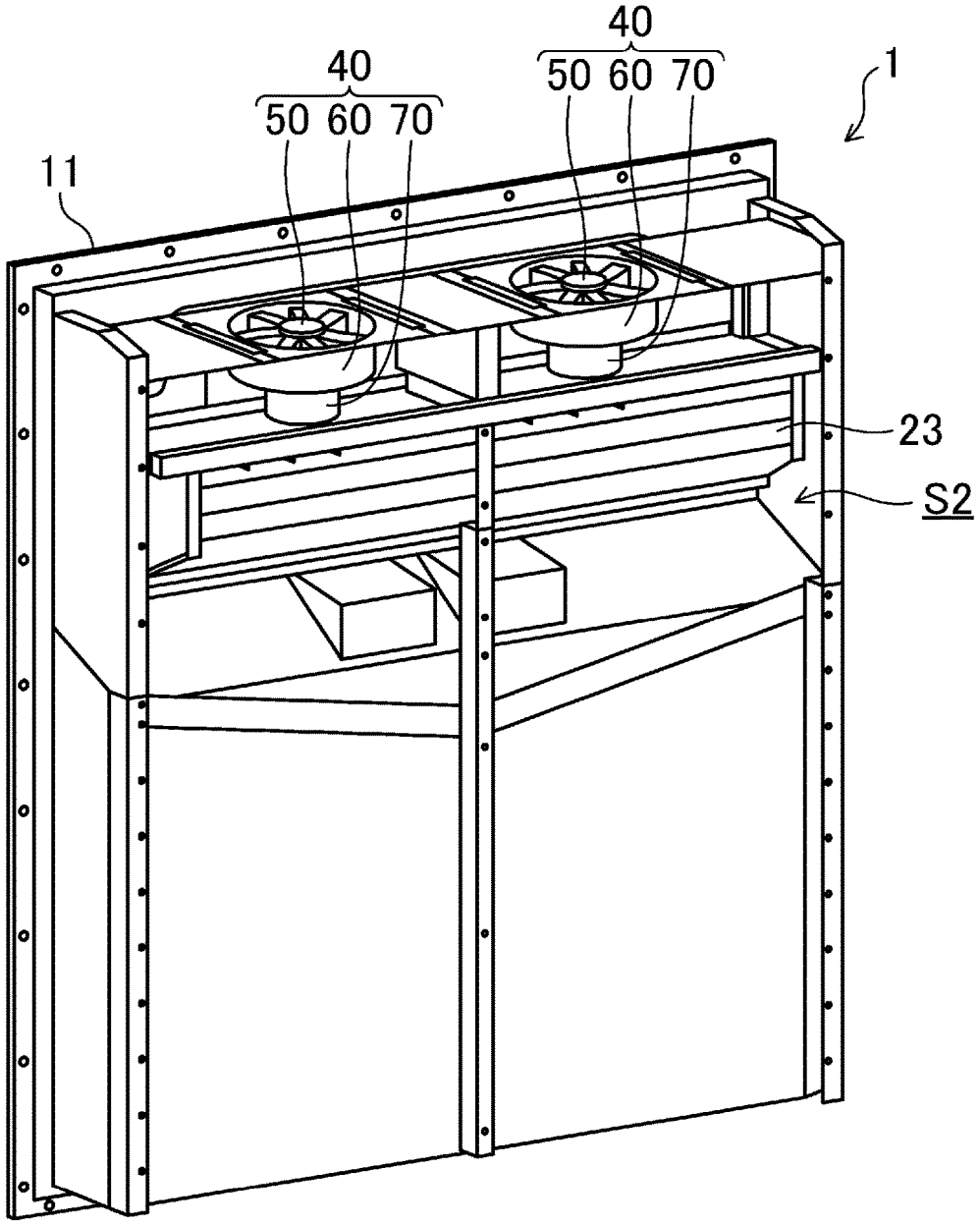
FIG. 3 is a perspective view illustrating the configuration of the container refrigeration device.

As shown in FIGS. 2 and 3, the casing (10) includes a casing body (11) and an interior partition wall (12). Note that FIG. 2 is a cross-sectional view showing a cross-section of the refrigeration device (1), the cross-section being parallel to a side surface of the container (2), which extends in longitudinal direction. FIG. 3 is a perspective view showing the refrigeration device (1) when viewed from inside the container (2).

《Casing Body》

The casing body (11) has a flat shape closing the open side of the container (2). A lower portion of the casing body (11) is bent so as to be recessed away from the exterior of the container and toward the interior. Forming such a casing body (11) results in an exterior storage space (S1), which is open toward the exterior, being formed in the lower portion of the casing body (11) outside the container, and an interior storage space (S2), which is open toward the interior, being formed in an upper portion of the casing (10) inside the container. Note that, in this example, the casing body (11) is a three-layered flat plate member including two metal plates and a heat insulating layer sandwiched between the metal plates.

《Interior Partition Wall》

The interior partition wall (12) has a flat shape partitioning the interior of the container (2) in a depth direction (longitudinal direction) of the container (2). The interior partition wall (12) is arranged in the casing body (11) inside the container leaving a gap between the interior partition wall (12) and the casing body (11). Arranging such an interior partition wall (12) defines the interior storage space (S2) separated from an interior space (S0) of the container (2) by an upper portion of the interior partition wall (12), and an interior communicating space (S3) communicating with the interior storage space (S2) and being formed between a lower portion of the interior partition wall (12) and the lower portion of the casing body (11).

Further, the interior partition wall (12) has a gap (upper gap) formed between an upper edge the interior partition wall (12) and a ceiling surface of the container (2), and a gap (lower gap) formed between a lower edge of the interior partition wall (12) and a bottom surface of the container (2). Forming such gaps allows an upper portion of the interior storage space (S2) to communicate with the interior space (S0) via the upper gap, and a lower portion of the interior storage space (S2) to communicate with the interior space (S0) via first the interior communicating space (S3) and then the lower gap.

〈Refrigeration Circuit〉

As shown in FIGS. 1, 2, and 3, the refrigeration circuit (20) includes a compressor (21), a condenser (22), an expansion valve (not shown), and an evaporator (23), by means of which a refrigeration cycle is operated. The compressor (21) and the condenser (22) are installed in the exterior storage space (S1), and the evaporator (23) is installed in the interior storage space (S2).

〈Exterior Blower Unit〉

As shown in FIGS. 1 and 2, the exterior blower unit (30) is installed in the exterior storage space (S1) and sends air (exterior air), which has been sucked from outside into the exterior storage space (S1), through the condenser (22) and out of the container. In this example, the exterior blower unit (30) includes an exterior propeller fan (31), and an exterior fan motor (32), which drives the exterior propeller fan (31)

in rotation. The condenser (22) is located at a leeward side of the exterior blower unit (30).

‹ Interior Blower Unit›

As shown in FIGS. 1, 2, and 3, the interior blower unit (40) is installed in the interior storage space (S2) and sends air (interior air), which has been sucked from inside the container into the interior storage space (S2), through the evaporator (23) and supplies the air into the container. In this example, the interior blower unit (40) includes an interior propeller fan (50), an interior fan housing (60) housing the propeller fan (50) in a rotatable manner, and an interior fan motor (70) driving the propeller fan (50) in rotation. Moreover, two interior blower units (40) are installed in the interior storage space (S2). The evaporator (23) is located at a leeward side of the two interior blower units (40). Note that the configuration of the interior blower units (40) will be described in detail later.

Moreover, in this example, a service opening (11*a*), which allows the interior blower unit (40) to be exposed from the container, and a service door (11*b*), which is capable of opening and closing the service opening (11*a*), are provided in an upper portion of the casing body (11).

‹ Controller› The controller (80) regulates the temperature inside the container (2) by controlling operation of the refrigeration circuit (20), the exterior blower unit (30), and the interior blower unit (40) based on results provided by various sensors (not shown), such as temperature sensors and humidity sensors. In this example, the controller (80) is installed in an electrical component box (81) housed in the exterior storage space (S1), as shown in FIG. 1.

‹ Refrigeration Operation of Refrigeration Device›

Next, a refrigeration operation of the refrigeration device (1) will be explained with reference to FIG. 2. In the scope of the refrigeration operation, the compressor (21), the exterior fan motor (32), and the interior fan motor (70) are driven, and the opening degree of the expansion valve (not shown) is regulated to a predetermined degree.

In the exterior storage space (S1), air (exterior air), which has been sucked from outside the container into the lower portion of the exterior storage space (S1), passes first through the condenser (22) and then through the exterior blower unit (30), and is discharged from the upper portion of the exterior storage space (S1) out of the container.

In the interior storage space (S2), air (interior air), which has been sucked from the interior space (S0) into the upper portion of the interior storage space (S2), passes first through the interior blower unit (40) and then through the evaporator (23). After having passed from the lower portion of the interior storage space (S2) through the interior communicating space (S3), the air is supplied back into the interior space (S0).

In the refrigeration circuit (20), a refrigerant, which has been discharged from the compressor (21), dissipates heat to the outside air and condenses in the condenser (22). Then, the refrigerant absorbs heat from the inside air and evaporates in the evaporator (23). Due to the heat absorption of the refrigerant, the interior air is cooled in the evaporator (23), and supplied into the container. Having passed through the evaporator (23), the refrigerant is sucked into the compressor (21).

[Interior Blower Unit (Blower Unit)]

Figure 4:
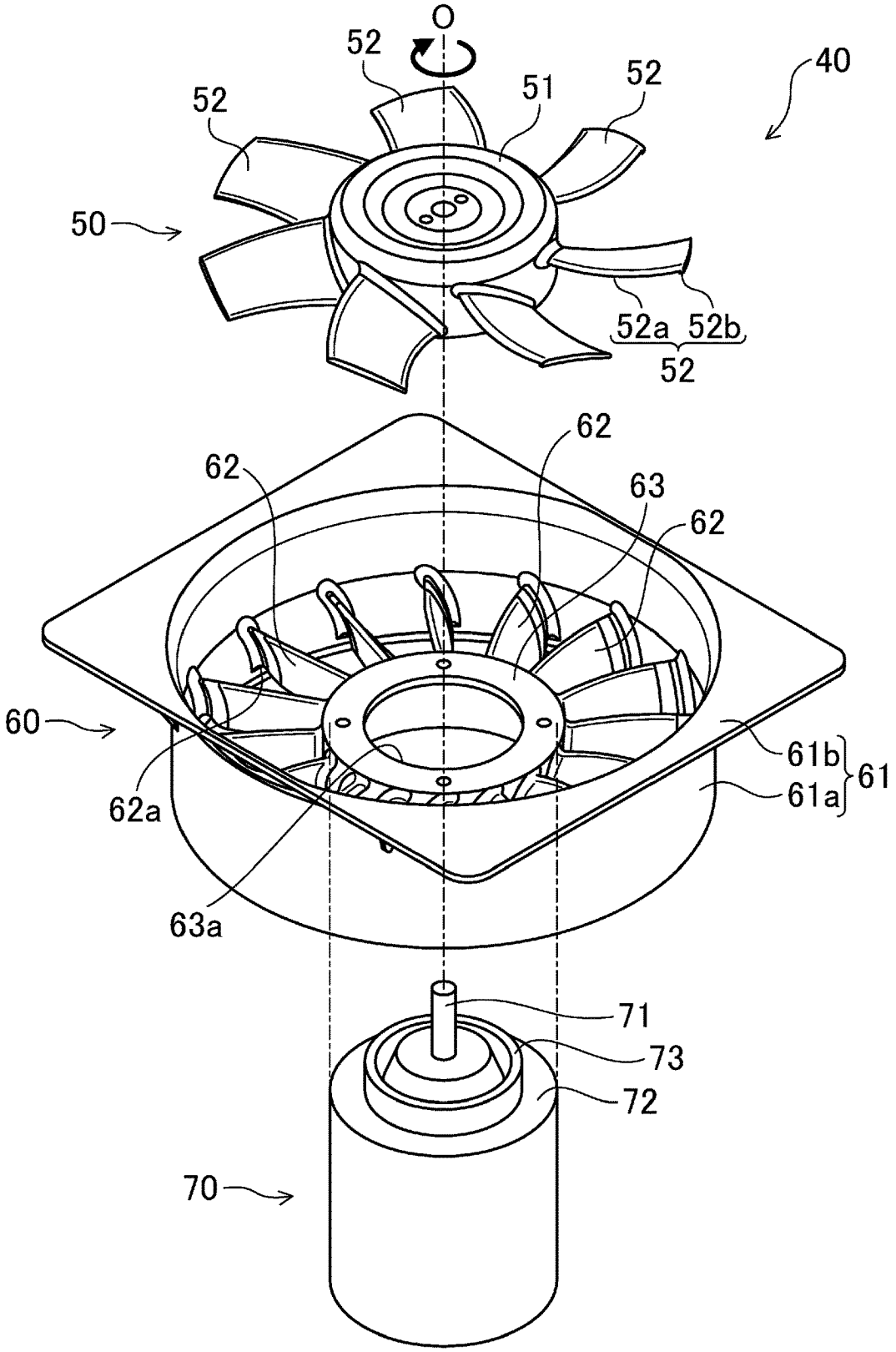
FIG. 4 is an exploded perspective view illustrating the configuration of a blower unit.
Figure 5:
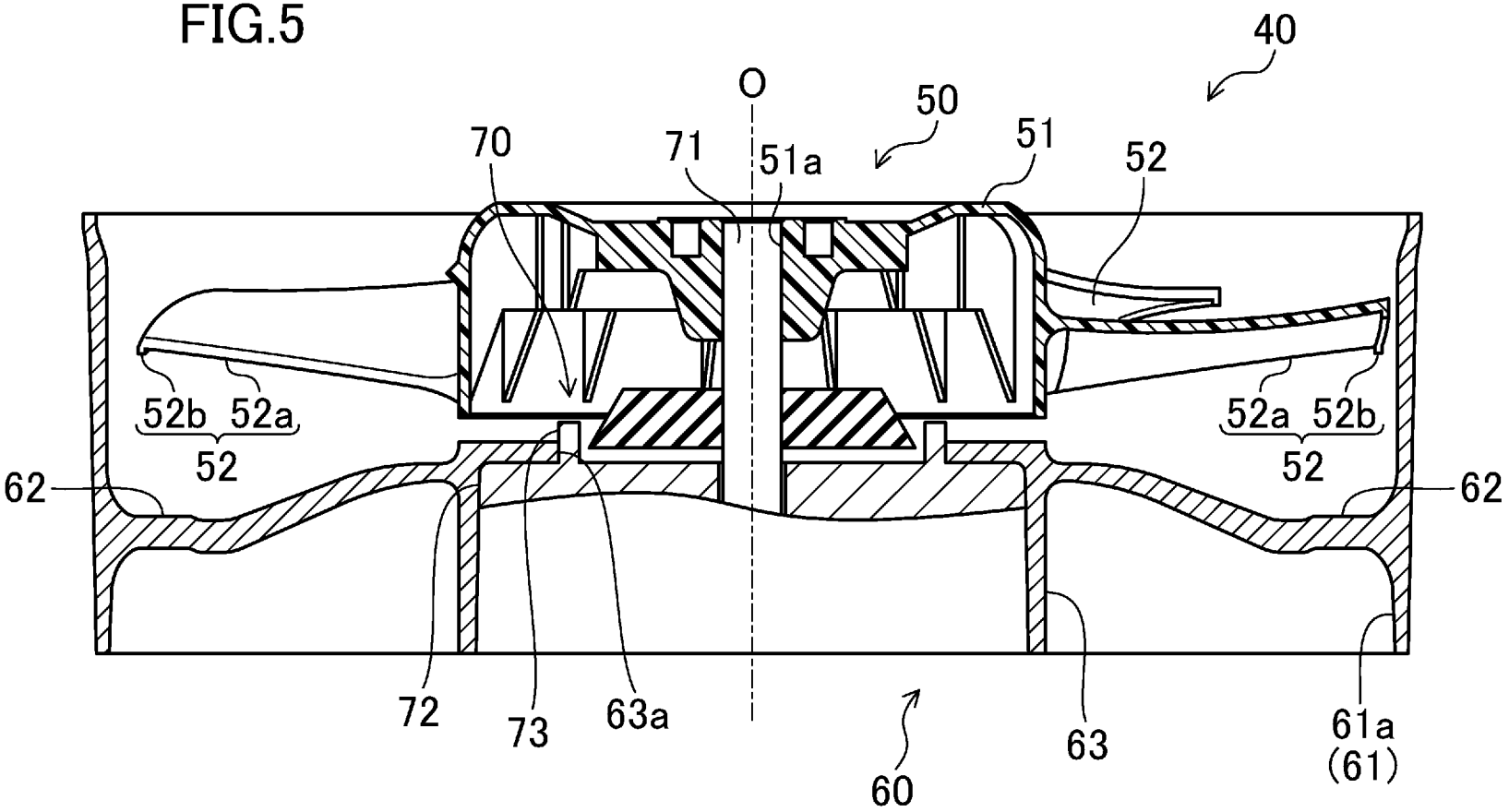
FIG. 5 is a longitudinal cross-sectional view illustrating the configuration of the blower unit.

Next, the interior blower unit will be described with reference to FIGS. 4 and 5. FIG. 4 is an exploded perspective view showing the interior blower unit (40). FIG. 5 is a longitudinal cross-sectional view showing a longitudinal cross-section of the interior blower unit (40). The interior blower unit (40) includes the interior propeller fan (50), the interior fan housing (60), and the interior fan motor (70).

Note that in the following description, the interior blower unit (40) is referred to as "blower unit (40)," the interior propeller fan (50) as "propeller fan (50)," the interior fan housing (60) as "fan housing (60)," and the interior fan motor (70) as "fan motor (70)."

Moreover, in the following description, "axial direction" is defined as a direction of a rotation axis (O), "radial direction" as a direction orthogonal to the axial direction of the rotation axis (O), and "circumferential direction" as a rotational direction around the rotation axis (O). The term "outer peripheral side" refers to a distal side relative to the rotation axis (O), whereas the term "inner peripheral side" refers to a proximal side relative to the rotation axis (O). Further, "leading edge side" is a windward side of a blade, while "rear edge side" is a leeward side of a blade. The term "pressure surface" is defined as a blade surface functioning as pressure side due to airflow occurring at the blade, and the term "suction surface" as a blade surface functioning as suction side due to the airflow occurring at the blade.

The propeller fan (50) is capable of rotating about the rotation axis (O) and sends air in the axial direction of the rotation axis (O). The fan housing (60) is installed at a leeward side of the propeller fan (50) and straightens the air blown out of the propeller fan (50) to make the air travel in the axial direction. The fan motor (70) includes a drive shaft (71) connected to the propeller fan (50), and drives the propeller fan (50) in rotation.

‹ Propeller Fan›

Figure 6:
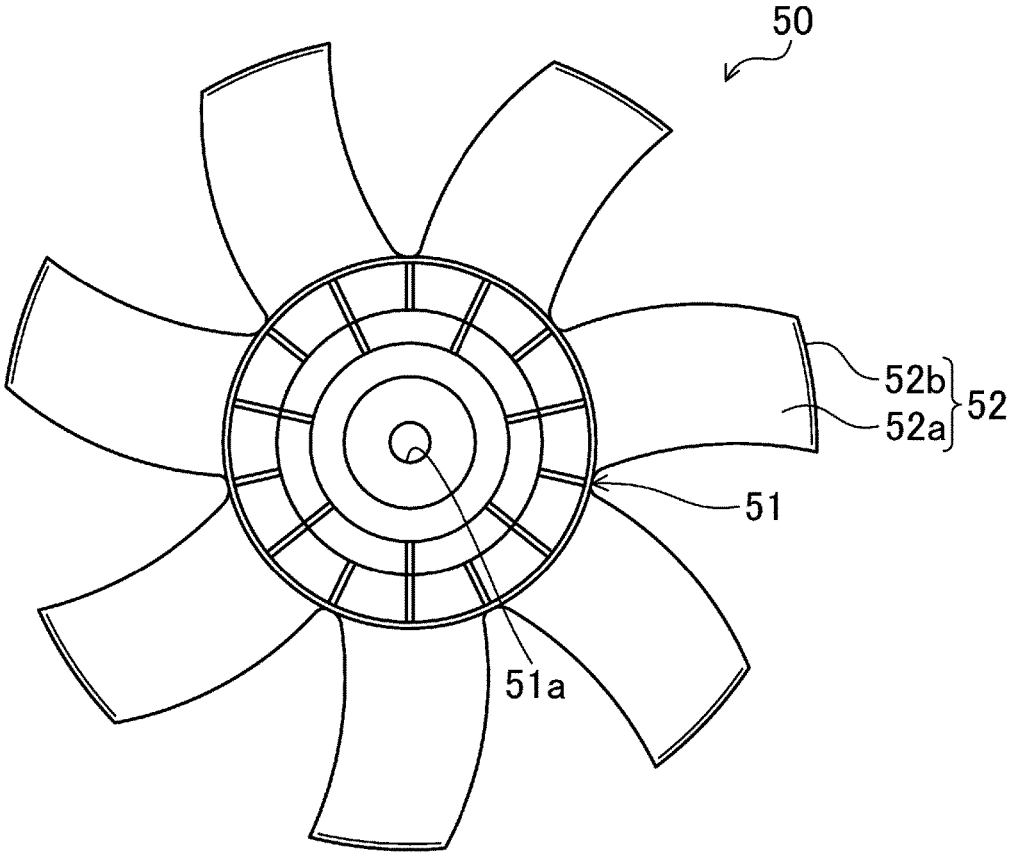
FIG. 6 is a plan view illustrating a configuration of a propeller fan.
Figure 7A:
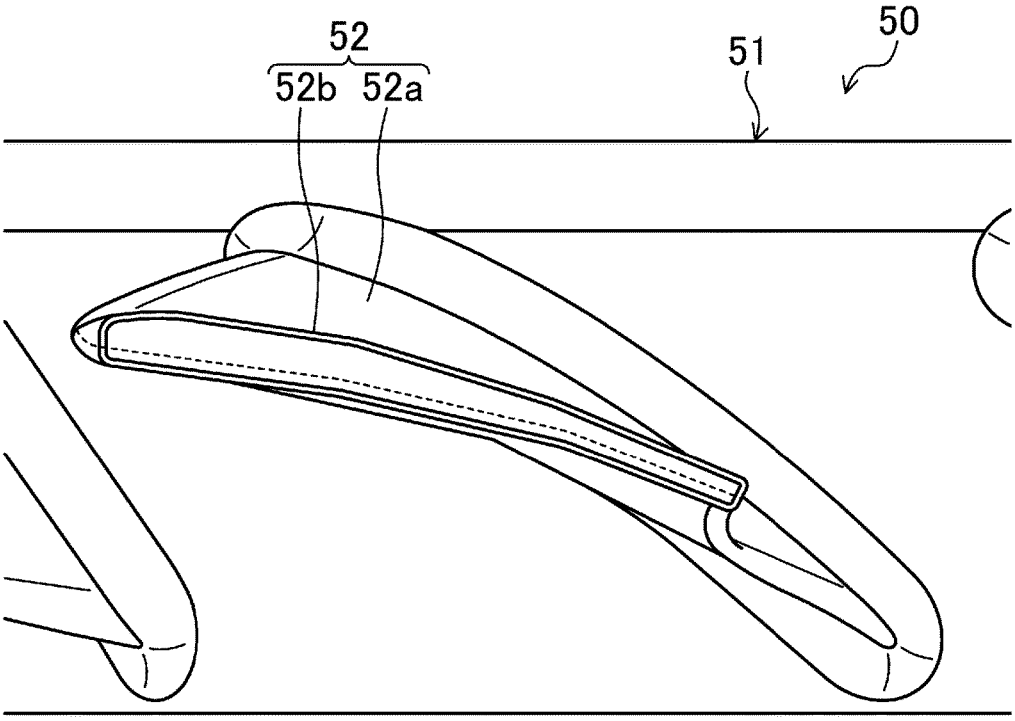
FIG. 7A is a partial side view illustrating main parts of the propeller fan.
Figure 7B:
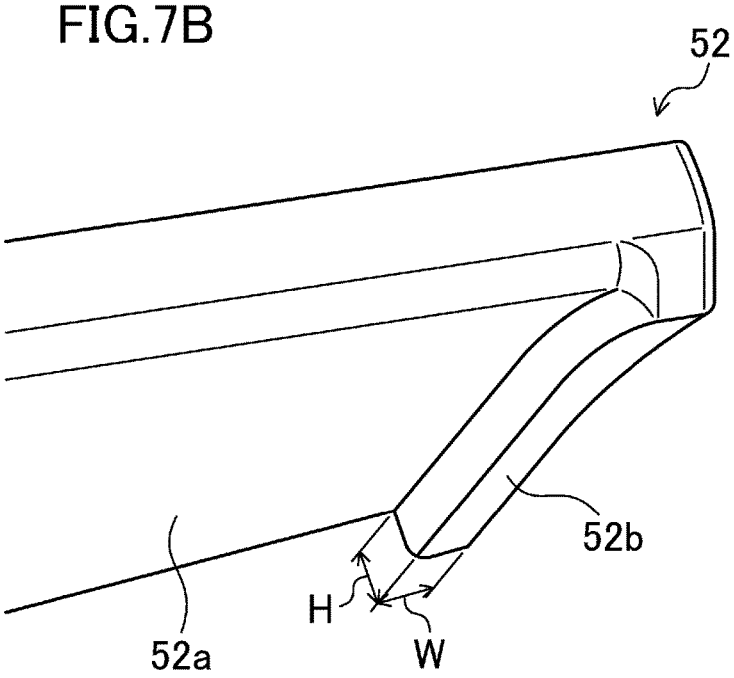
FIG. 7B is a partial perspective view illustrating main parts of the propeller fan.

In the following, the propeller fan (50) will be explained with reference to FIGS. 4, 5, 6, 7A and 7B. The propeller fan (50) includes a rotary blade hub (51), and a plurality of rotary blades (52) (seven in this example). The rotary blade hub (51) and the rotary blades (52) of the propeller fan (50) are, for example, integrally formed by resin molding. Note that FIG. 6 is a plan view showing the propeller fan (50) when viewed from a windward side (air suction side). FIG. 7A is an enlarged partial side view of the rotary blade (52) when viewed from radially outward. FIG. 7B is an enlarged partial perspective view of the rotary blade (52) when viewed with a leading edge portion as front face.

« Rotary Blade Hub »

The rotary blade hub (51) is connected to the drive shaft (71) of the fan motor (70) and driven in rotation about the rotation axis (O). In this example, the rotary blade hub (51) has a cylindrical shape including a bottom wall with a thick center portion. This bottom wall is located at the windward side (an upper side in this example). Further, a shaft hole (51*a*), into which the drive shaft (71) is inserted and fixed, is formed in the center portion (that is, the thick portion) of the bottom wall of the rotary blade hub (51).

« Rotary Blade »

The plurality of rotary blades (52) is installed in the outer periphery of the rotary blade hub (51) and arranged in the radial direction at a predetermined interval. Specifically, the plurality of rotary blades (52) extends in a radial manner from the rotary blade hub (51) radially outward. Each of the rotary blades (52) includes a rotary blade body (52*a*) and a rib (52*b*).

—Rotary Blade Body—

The rotary blade body (52*a*) projects from an outer peripheral surface of the rotary blade hub (51) radially outward. Specifically, in order for air to travel in the axial direction of the rotation axis (O), the rotary blade body (52*a*) has an inner peripheral edge portion connected to the outer peripheral surface of the rotary blade hub (51), while a chord line of the rotary blade body (52*a*) is inclined with respect to the circumferential direction of the rotation axis (O) (i.e., a rotation direction of the propeller fan (50)). Further, a pressure surface of the rotary blade body (52*a*) has a concave shape, while a suction surface has a convex shape. Moreover, the outer peripheral surface of the rotary blade body (52*a*) has a cylindrical shape enclosing the rotation axis (O) (specifically, a cylindrical shape extending in the axial direction about the rotation axis (O); the same hereinafter).

Note that, in this example, the rotary blade body (52*a*) is inclined clockwise with respect to the circumferential direction of the rotation axis (O) when viewed from radially outward. As a result, in the vertically extending axial direction, a leading edge portion of the rotary blade body (52*a*) is at an upper side and a rear edge portion of the rotary blade body (52*a*) is at a lower side. When the propeller fan (50) is driven, air travels from the upper side toward the lower side of the propeller fan (50).

—Rib—

The rib (52*b*) is formed on an outer peripheral edge portion of the pressure surface of the rotary blade body (52*a*) so as to extend along the outer peripheral edge of the rotary blade body (52*a*). Further, the rib (52*b*) has an outer peripheral surface of a cylindrical shape enclosing the rotation axis (O) (specifically, a cylindrical shape having the same diameter as the outer peripheral surface of the rotary blade body (52*a*)). The outer peripheral surface of the rib (52*b*) is flush with the outer peripheral surface of the rotary blade body (52*a*). Moreover, the rib (52*b*) has an inner peripheral surface formed so as to stand upright with respect to the pressure surface of the rotary blade body (52*a*). In this example, the inner peripheral surface of the rib (52*b*) has a cylindrical shape enclosing the rotation axis (O).

Further, in this example, the rib (52*b*) is foamed such that its height (H) remains the same from a leading edge side of the rotary blade body (52*a*) along a rear edge side. Moreover, the rib (52*b*) is formed such that its width (W) remains the same from the leading edge side of the rotary blade body (52*a*) along the rear edge side. Note that the height (H) of the rib (52*b*) defines how high the rib (52*b*) protrudes with respect to the pressure surface of the rotary blade body (52*a*) (in this example, the length in the axial direction), while the width (W) of the rib (52*b*) defines the length of the rib in the radial direction.

For example, the propeller fan (50) may have an outer diameter (specifically, the diameter of an outer peripheral surface of the rotary blade (52)) of approximately 340 mm. The rib (52*b*) may have a height (H) of approximately 1.5 mm and a width (W) of approximately 2.0 mm.

〈Fan Housing〉

Figure 8:
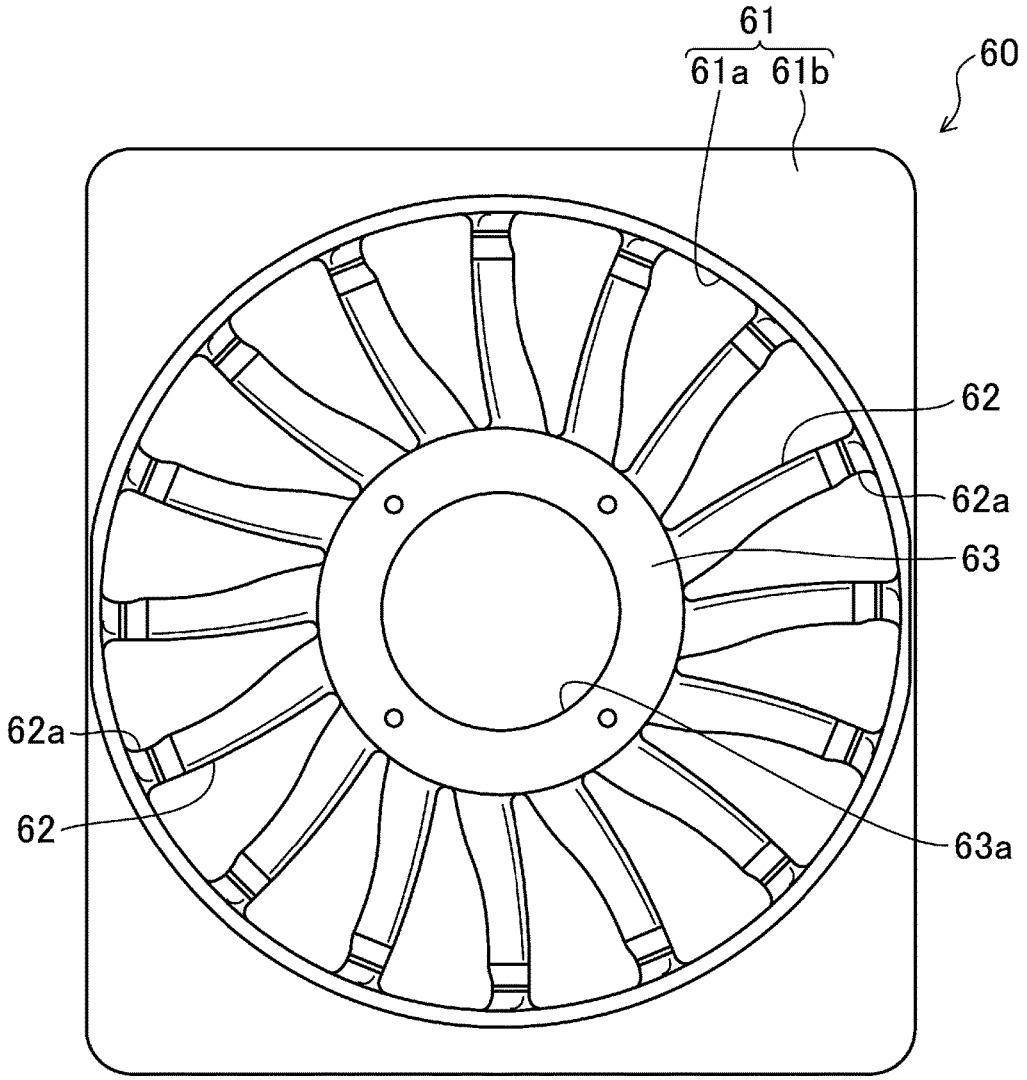
FIG. 8 is a plan view illustrating a configuration of a fan housing.
Figure 9A:
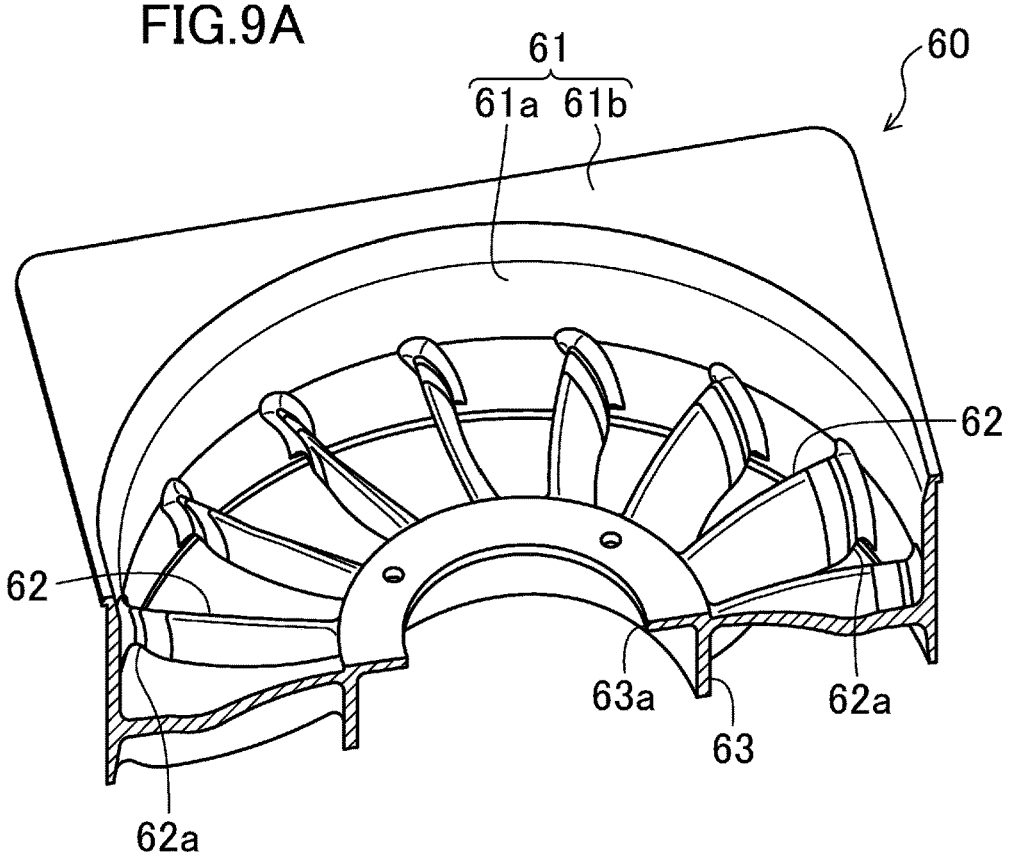
FIG. 9A is a perspective view illustrating the configuration of the fan housing.
Figure 9B:
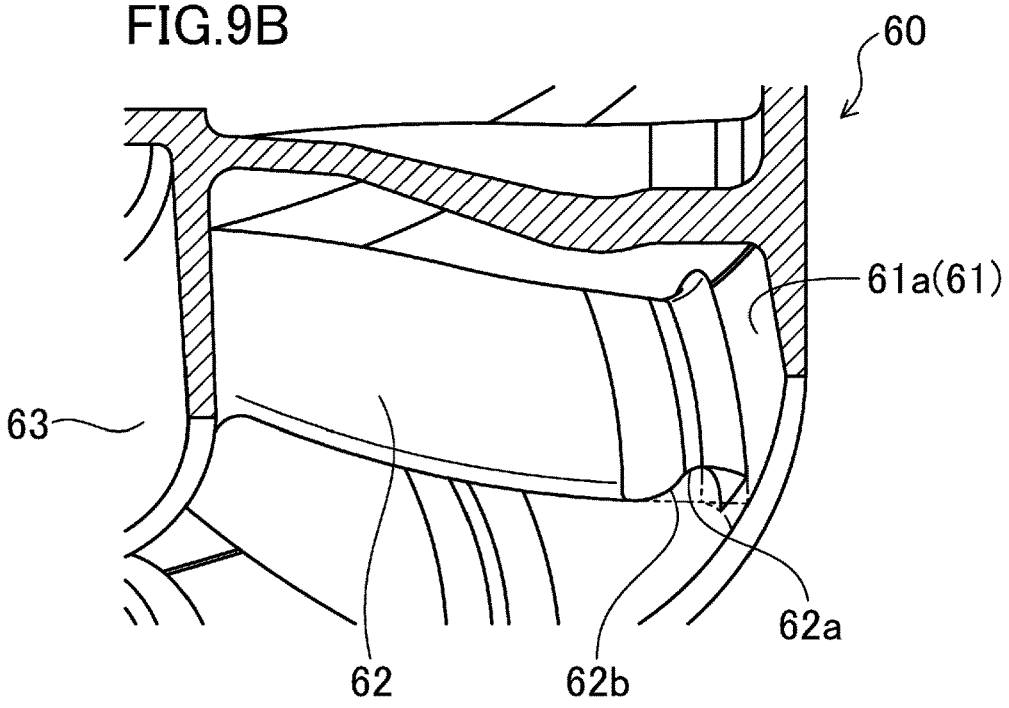
FIG. 9B is a partial perspective view illustrating main parts of the fan housing.

Now, the fan housing (60) will be described with reference to FIGS. 4, 5, 8, 9A and 9B. The fan housing (60) includes a housing body (61), a plurality of static blades (62) (sixteen in this example), and a static blade hub (63). For example, the housing body (61), the plurality of static blades (62), and a static blade hub (63) of the fan housing (60) may be integrally formed by metal casting. Note that FIG. 8 is a plane view showing the fan housing (60) when viewed from a windward side (side where air enters). FIG. 9A is a perspective view of the fan housing (60) when viewed from the windward side (side where air enters). In FIG. 9A, a part (half a circumference) of the fan housing (60) is broken away. FIG. 9B is an enlarged partial perspective view showing the static blade (62) when viewed from a leeward side (side where air exits). Further, in FIG. 5, parts of the static blade (62) that are located further in the background than the surface of the cross-section (the cross-section seen on the drawing) are omitted.

《Housing Body》

The housing body (61) is installed so as to enclose an outer peripheral edge of the propeller fan (50), and has an interior space allowing air sent by the propeller fan (50) to pass through. That is, the housing body (61) has an inner peripheral surface of a cylindrical shape (specifically, a cylindrical shape having a diameter larger than the outer diameter of the propeller fan (50)) enclosing the rotation axis (O). This inner peripheral surface forms an air duct (specifically, an air duct allowing air sent by the propeller fan (50) to pass through). In this example, the propeller fan (50) is housed, in a rotatable manner, at a windward side of an interior space of the housing body (61). The plurality of static blades (62) is fixed at the leeward side of this interior space. Further, the housing body (61) has portions formed integrally, that is, one portion enclosing an outer periphery of the propeller fan (50) and another portion enclosing an outer periphery of the plurality of static blades (62). Specifically, the housing body (61) includes a cylinder (61*a*) and a flange (61*b*).

—Cylinder—

The cylinder (61*a*) has an inner peripheral surface of a cylindrical shape enclosing the rotation axis (O). Further, a part of the cylinder (61*a*) other than an edge portion at the windward side has a constant inner diameter, whereas the edge portion at the windward side has an inner diameter gradually becoming larger from a leeward side toward a windward side. That is, a portion of the cylinder (61*a*) enclosing the outer periphery of the propeller fan (50) is a bell mouth for leading air to the propeller fan (50), whereas a portion of the cylinder (61*a*) enclosing an outer peripheral edge of the plurality of static blades (62) is a shroud for supporting the plurality of static blades (62).

—Flange—

The flange (61*b*) projects from the edge portion (open end) of the cylinder (61*a*) at the windward side in the radial direction. The flange (61*b*) has a rectangular shape when viewed in planar fashion. A circular opening is formed in a center portion of the flange (61*b*) to communicate with the open end of the cylinder (61*a*) at the windward side.

《Static Blade》

The plurality of static blades (62) is provided for an inner periphery of the housing body (61) to be located at the leeward side (side where air is blown out) of the propeller fan (50). The plurality of static blades (62) straightens the airflow blown out of the propeller fan (50). Further, the static blades (62) are arranged in the circumferential direction at a predetermined interval. Each static blade (62) projects from the inner peripheral surface of the housing body (61) radially inward. Moreover, each static blade (62) converts dynamic pressure (kinetic energy) of air blown out of the propeller fan (50) into static pressure (pressure energy). Specifically, in order for air blown by the propeller fan (50) to travel along a pressure surface of the static blade (62), flow from a rear edge in the axial direction, and be blown out toward the leeward side, each static blade (62) has an outer peripheral edge portion connected to the inner peripheral surface of the housing body (61), while a chord line of the static blades (62) is inclined with respect to the circumferential direction of the rotation axis (O) (i.e., the rotation direction of the propeller fan (50)). Further, the static blades (62) have a concave pressure surface and a convex suction surface. Furthermore, in this example, the outer peripheral edge portion of the static blades (62) has a thickness (length in the circumferential direction) gradually increasing from an inner peripheral side toward an outer peripheral side.

—Notch—

Further, a notch (62*a*) is formed at an outer peripheral side of a rear edge portion of the static blade (62). Specifically, the notch (62*a*) becomes deeper from the inner peripheral side toward the outer peripheral side of the static blade (62). In this example, the notch (62*a*) has a right-angled trapezoidal shape with its upper base serving as leading edge side and its lower base serving as rear edge side. Moreover, a hypotenuse of the notch (62*a*) gradually curves from the rear edge side toward the leading edge side as it proceeds from the inner peripheral side to the outer peripheral side, such that the hypotenuse is convex at an outward side of the static blade (62).

For example, the housing body (61) may have an inner diameter (specifically, the diameter of the inner peripheral surface of the cylinder (61*a*)) of approximately 345 mm. The notch (62*a*) may have an upper base of approximately 10 mm, a lower base of approximately 20 mm, and a height (depth) of approximately 10 mm.

—Corner—

Further, by forming the notch (62*a*) at the outer peripheral side of the rear edge portion of the static blade (62), a corner (62*b*) is formed at an inner peripheral side of the notch (62*a*) of the static blade (62). In this example, the static blade (62) has a chamfered corner (i.e., the corner (62*b*) adjacent to the inner peripheral side of the notch (62*a*)). Note that, in FIG. 9B, a contour of the outer peripheral side of the rear edge portion of the static blade (62) in the case where no notch (62*a*) is formed is shown in phantom lines (dot-dot-dash line).

Note that, in this example, the static blade (62) is inclined counterclockwise with respect to the circumferential direction of the rotation axis (O) when viewed from radially outward. As a result, in the vertically extending axial direction, a leading edge portion of the static blade (62) is at an upper side (i.e., a side proximal to the propeller fan (50)) and the rear edge portion is at a lower side (i.e., a side distal from the propeller fan (50)). Further, an angle of inclination of the static blade (62) with respect to the circumferential direction of the rotation axis (O) is steeper than an angle of inclination of the rotary blade body (52*a*) with respect to the circumferential direction of the rotation axis (O). Moreover, air blown out of the propeller fan (50) travels along the pressure surface of the static blade (62) from the upper side toward the lower side, and is blown out from the rear edge of the static blade (62) along the axial direction toward the lower side.

《Static Blade Hub》 The static blade hub (63) is installed at an inner periphery of the plurality of static blades (62) so as to be axially aligned with the rotary blade hub (51) of the propeller fan (50). An inner peripheral edge portion of each of the static blades (62) is connected to an outer peripheral surface of the static blade hub (63). That is, the plurality of static blades (62) extends in a radial manner from the outer peripheral surface of the static blade hub (63) toward the inner peripheral surface of the housing body (61).

In this example, the outer peripheral surface of the static blade hub (63) has a cylindrical shape (specifically, a cylindrical shape having a smaller diameter than the inner peripheral surface of the housing body (61)) enclosing the rotation axis (O). The outer peripheral surface of the static blade hub (63) and the inner peripheral surface of the housing body (61) face each other across the plurality of static blades (62). Further, the static blade hub (63) is attachable to one end of the fan motor (70). Specifically, the static blade hub (63) has a cylindrical shape including a bottom wall. This closed end (i.e., the bottom wall) is arranged proximal to the propeller fan (50) (the upper side in this example), whereas an open end is arranged distal from the propeller fan (50). Moreover, a through hole (63*a*) is formed in a center portion of the bottom wall of the static blade hub (63).

〈Fan Motor〉

Next, the fan motor (70) will be explained with reference to FIGS. 4 and 5. Apart from the drive shaft (71), the fan motor (70) includes a motor body (72) and a protruding ring portion (73). Note that, in FIG. 5, only the one end of the fan motor (70) is shown and that parts other than the one end are omitted from the drawing.

The motor body (72) has a cylindrical outer shape extending in the axial direction about a shaft center (i.e., the rotation axis (O)) of the drive shaft (71). The drive shaft (71) extends in the axial direction from a center portion of an end surface of the motor body (72). The protruding ring portion (73) projects from the end surface of the motor body (72), and has the shape of a ring enclosing an outer periphery of the drive shaft (71). Note that the protruding ring portion (73) has an outer peripheral surface of a cylindrical shape (specifically, a cylindrical shape having a smaller diameter than the outer peripheral surface of the motor body (72)) enclosing the rotation axis (O).

Moreover, the static blade hub (63) has an inner peripheral surface of a cylindrical shape (specifically, a cylindrical shape having a diameter slightly larger than an outer peripheral surface of the motor body (72)) corresponding to the outer peripheral surface of the motor body (72). Further, the through hole (63*a*) of the static blade hub (63) has a cylindrical shape (specifically, a cylindrical shape having a diameter slightly smaller than the outer peripheral surface of the motor body (72) and slightly larger than the outer peripheral surface of the protruding ring portion (73)) corresponding to the outer peripheral surface of the protruding ring portion (73).

〈Assembly of Blower Unit〉

As shown in FIG. 5, the protruding ring portion (73) of the fan motor (70) is fitted into the through hole (63*a*) of the static blade hub (63), and the motor body (72) is fitted into an inner periphery of the static blade hub (63). In this way, the fan housing (60) is attached and fixed (for example with bolts) to the one end of the motor (70). After the fan housing (60) has been attached to the one end of the motor (70), one end of the drive shaft (71) of the motor (70) is inserted into the shaft hole (51*a*) of the rotary blade hub (51) and fixed. In this way, the propeller fan (50) is fixed to one end of the drive shaft (71).

〈Airflow at Rotary Blade〉

Figure 10B:
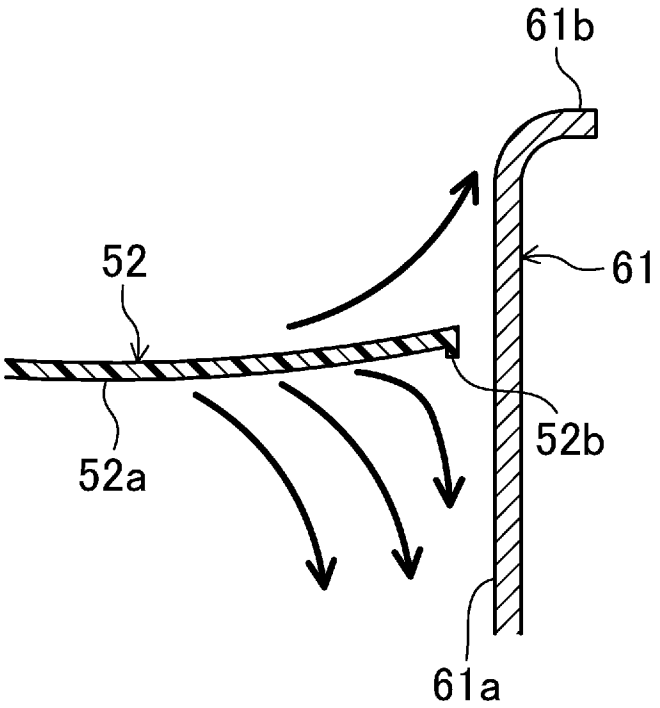
FIG. 10A schematically illustrates a flow of air in a propeller fan according to a comparative example, and FIG. 10B schematically illustrates a flow of air in a propeller fan according to an embodiment.
Figure 10A:
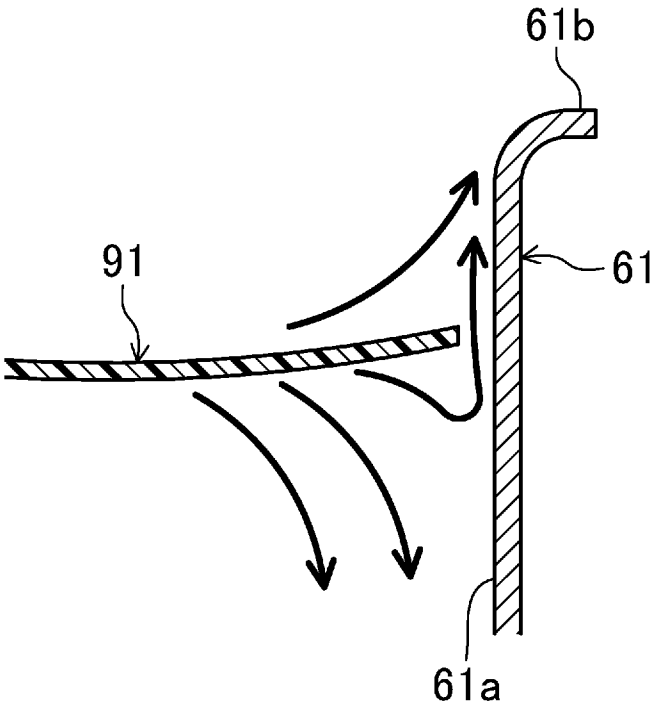

Next, airflow occurring at the rotary blade (52) of the propeller fan (50) will be explained with reference to FIGS. 10A and 10B. Here, a rotary blade (52) including no rib (52*b*) will be described as comparative example. FIG. 10A shows airflow at the rotary blade (52) of the comparative example (hereinafter "rotary blade (91)"), while FIG. 10B shows airflow at rotary blade (52) of the propeller fan (50) of this embodiment. In FIGS. 10A and 10B, airflow is indicated by solid arrows.

Air sucked into the propeller fan (50) travels along a pressure surface of the rotary blade (52) from a leading edge side toward a rear edge side. At the same time, centrifugal force generated by the rotation of the propeller fan (50) makes the air travel from an inner peripheral side toward an outer peripheral side. Therefore, as shown in FIG. 10A, at an outer peripheral edge portion of the rotary blade (91) including no rib (52*b*), air, which has traveled along a pressure surface of the rotary blade (91) toward the outer peripheral edge portion of the rotary blade (91), is at risk to travel beyond an outer peripheral edge of the rotary blade (91) and to flow back to a suction surface side of the rotary blade (91).

On the other hand, as shown in FIG. 10B, at the rotary blade (52) including the rib (52*a*), air, which has traveled along the pressure surface of the rotary blade body (52*a*) toward the outer peripheral edge portion of the rotary blade body (52*a*), impacts on the rib (specifically, the inner peripheral surface of the rib (52*b*)) and is guided along the rib (52*b*) to a leeward side. This may reduce the risk of air, which has traveled along the pressure surface of the rotary blade body (52*a*) toward the outer peripheral edge of the rotary blade body (52*a*), traveling beyond the outer peripheral edge of the rotary blade body (52*a*) and flowing back to a suction surface side.

‹ Airflow at Static Blade›

Figure 11B:
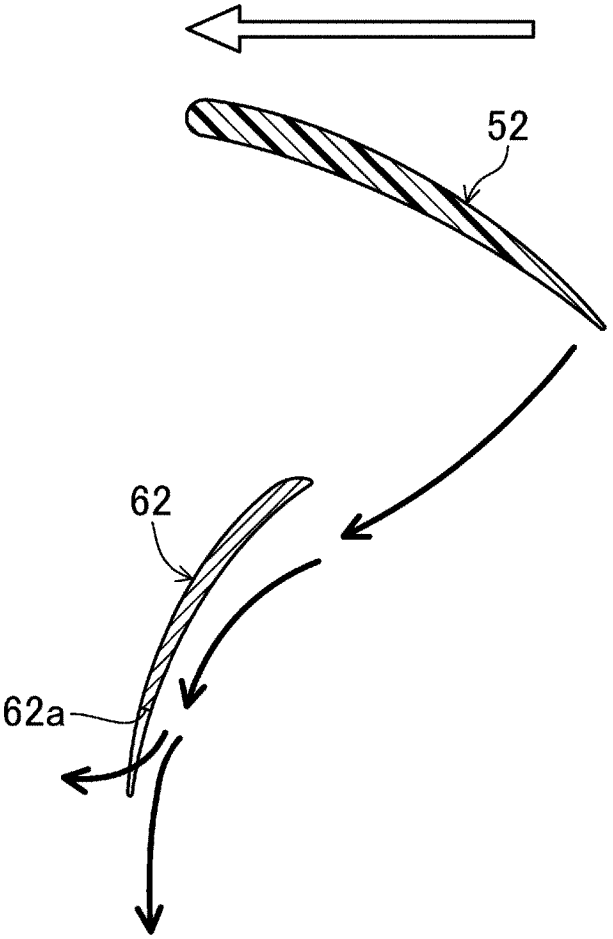
FIG. 11A schematically illustrates a flow of air in a comparative example of the fan housing, and FIG. 11B schematically illustrates a flow of air in the fan housing.
Figure 11A:
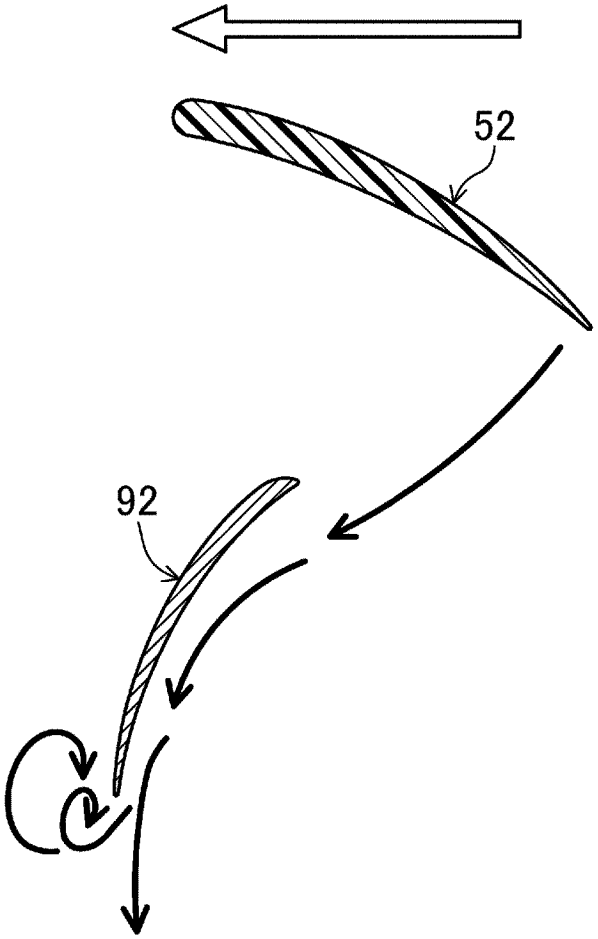

Next, airflow at the static blade (62) of the fan housing (60) will be explained with reference to FIGS. 11A and 11B. Here, a static blade (62) including no notch (62*a*) will be described as comparative example. FIG. 11A shows airflow at the static blade (62) of the comparative example (hereinafter "static blade (92)"), while FIG. 11B shows airflow at the static blade (62) of the fan housing (60) of this embodiment. Note that FIGS. 11A and 11B are schematic drawings of the rotary blade (52) and the static blades (92, 62) when viewed from radially outward. In FIGS. 11A and 11B, airflow is indicated by solid arrows, whereas the direction of rotation of the propeller fan (50) is indicated by outlined arrows.

Air blown out of the propeller fan (50) swirls in the circumferential direction while spreading from an inner peripheral side toward an outer peripheral side due to torque of the propeller fan (50), and proceeds in the axial direction from the windward side toward the leeward side. Therefore, in the fan housing (60), wind velocity is higher at an outer peripheral side of a pressure surface of the static blade (62) than at an inner peripheral side. That is, air traveling toward the outer peripheral side of the rear edge portion of the static blade (62) travels at higher velocity than air traveling toward an inner peripheral side of the rear edge portion of the static blade (62). Thus, as shown in FIG. 11A, at the static blade (92) including no notch (62*a*), a Kármán vortex may easily form at an outer peripheral side of a rear edge portion of the static blade (92).

Now, the formation of a Kármán vortex will explained in more detail. At the static blade (92) shown in FIG. 11A, a Kármán vortex may form at the rear edge of the static blade (92) when air, which has traveled to the rear edge portion of the static blade (92), impacts on the rear edge portion of the static blade (92) and its flow is separated. Moreover, the higher the velocity of air traveling toward the rear edge portion of the static blade (92) is, the greater the risk becomes that a Kármán vortex forms when this air impacts on the rear edge portion of the static blade (92) and its flow is separated. Further, at the static blade (92) shown in FIG. 11A, wind velocity is higher at an outer peripheral side of a pressure surface of the static blade (92) than at an inner peripheral side, which increases the risk of a Kármán vortex forming at the outer peripheral side of the rear edge portion of the static blade (92).

On the other hand, as shown in FIG. 11B, at the static blade (62) including the notch (62*a*), air, which has traveled to the outer peripheral side of the rear edge portion of the static blade (62), passes through the notch (62*a*) formed on the outer peripheral side of the rear edge portion of the static blade (62). This reduces the risk of air impacting on the static blade (62) at the outer peripheral side of the rear edge portion of the static blade (62), which reduces the risk of a Kármán vortex forming at the outer peripheral side of the rear edge portion of the static blade (62).

‹ Advantages of Embodiment›

As can be seen from the above, providing the rib (52*b*) on the rotary blade (52) of the propeller fan (50) may reduce the risk of air flowing back from a pressure surface side to a suction surface side at the outer peripheral edge portion of the rotary blade (52). This may reduce the risk of a decrease in the amount of air blown out of the propeller fan (50) toward the leeward side, which may increase the air blow efficiency of the propeller fan (50). As a result, the air blow efficiency of the blower unit (40) may be increased.

Moreover, forming the outer peripheral surface of the rib (52*b*) of the rotary blade (52) in a cylindrical shape and flushing the outer peripheral surface of the rib (52*b*) with the outer peripheral surface of the rotary blade body (52*a*) allows for forming the outer peripheral surface of the rotary blade (52) in a cylindrical shape. Note that, generally, a member (e.g., a bell mouth or a fan housing; the housing body (61) in this example) enclosing the outer periphery of the propeller fan (50) has an inner peripheral surface of a cylindrical shape (specifically, a cylindrical shape having a diameter larger than the outer diameter of the propeller fan (50)) enclosing the rotation axis (O). Thus, forming the outer peripheral surface of the rotary blade (52) in a cylindrical shape (i.e., a shape corresponding to the inner peripheral surface of the member enclosing the outer periphery of the propeller fan (50)) allows for narrowing the gap (hereinafter "rotary blade gap") between the outer peripheral surface of the rotary blade (52) and the inner peripheral surface of the member enclosing the outer periphery of the propeller fan (50). This may reduce the risk of air, which has traveled along a pressure surface of the rotary blade body (52*a*) toward the outer peripheral edge portion of the rotary blade body (52*a*), flowing through the rotary blade gap and back to the suction surface side. By this, the risk of air flowing back from the pressure surface side to the suction surface side of the rotary blade (52) via the rotary blade gap may be reduced. This may improve the air blow efficiency of the propeller fan (50).

Further, forming the rib (52*b*) such that the inner peripheral surface of the rib (52*b*) stands upright with respect to the pressure surface of the rotary blade body (52*a*) may reliably lower the risk of airflow occurring at the outer peripheral edge portion of the pressure surface of the rotary blade body (52*a*) from an inner peripheral side toward an outer peripheral side. By this, at the outer peripheral edge portion of the rotary blade (52), the risk of air flowing back from the pressure surface side to the suction surface side may be reliably reduced. This may reliably improve the air blow efficiency of the propeller fan (50).

Furthermore, housing the propeller fan (50) of the blower unit (40) in the fan housing (60) allows for straightening airflow blown out of the propeller fan (50) (specifically, redirecting airflow progressing in the circumferential direction into airflow progressing in the axial direction). This allows for converting dynamic pressure (kinetic energy) of air blown out of the propeller fan (50) into static pressure (pressure energy). Thus, the static pressure at the leeward side of the blower unit (40) may be increased.

Further, providing the notch (62*a*) at the outer peripheral side of the rear edge portion of the static blade (62) of the fan housing (60) may lower the risk of a Kármán vortex forming at the outer peripheral side of the rear edge portion of the static blade (62). This lowers the risk of a decrease in the amount of air blown out from the static blade (62) toward the leeward side. Thus, the risk of a decrease in the air blow efficiency at the fan housing (60) may be decreased, and, as a result, the air blow efficiency of the propeller fan (50) may be improved.

Furthermore, chamfering the corner (62*b*) adjacent to the inner peripheral side of the notch (62*a*) of the static blade (62) may lead to a smooth airflow at the corner (62*b*) of the static blade (62). In this way, the risk of a Kármán vortex forming at the corner (62*b*) of the static blade (62) may be reduced. This may reduce the risk of a decrease in the air blow efficiency at the fan housing (60).

Further, on the outer peripheral side of the static blade (62), the notch (62*a*) is formed so as to become deeper from the inner peripheral side of the static blade (62) toward the outer peripheral side. Note that, at the outer peripheral side of the rear edge portion of the static blade (62), the velocity of air traveling toward the rear edge portion of the static blade (62) becomes higher from the inner peripheral side toward the outer peripheral side. Therefore, at the outer peripheral side of the rear edge portion of the static blade (62), the risk of a Kármán vortex forming becomes higher from the inner peripheral side toward the outer peripheral side. Consequently, the risk of a Kármán vortex forming at the outer peripheral side of the rear edge portion of the static blade (62) may be effectively reduced by forming the notch (62*a*) such that the notch (62*a*) becomes deeper from the inner peripheral side of the static blade (62) toward the outer peripheral side. This may effectively reduce the risk of a decrease in the air blow efficiency at the fan housing (60).

Moreover, the housing body (61) is constructed such that the portion enclosing the outer periphery of the propeller fan (50) is formed integrally with the portion enclosing the outer periphery of the plurality of static blades (62). In this manner, the risk of air leakage occurring at the housing body (61) (specifically, air leakage occurring between the portion enclosing the outer periphery of the propeller fan (50) and the portion enclosing the outer periphery of the plurality of static blades (62)) may be reduced. This may reduce the risk of a decrease in the air blow efficiency at the fan housing (60).

[Variation of Rotary Blade]

Figure 12A:
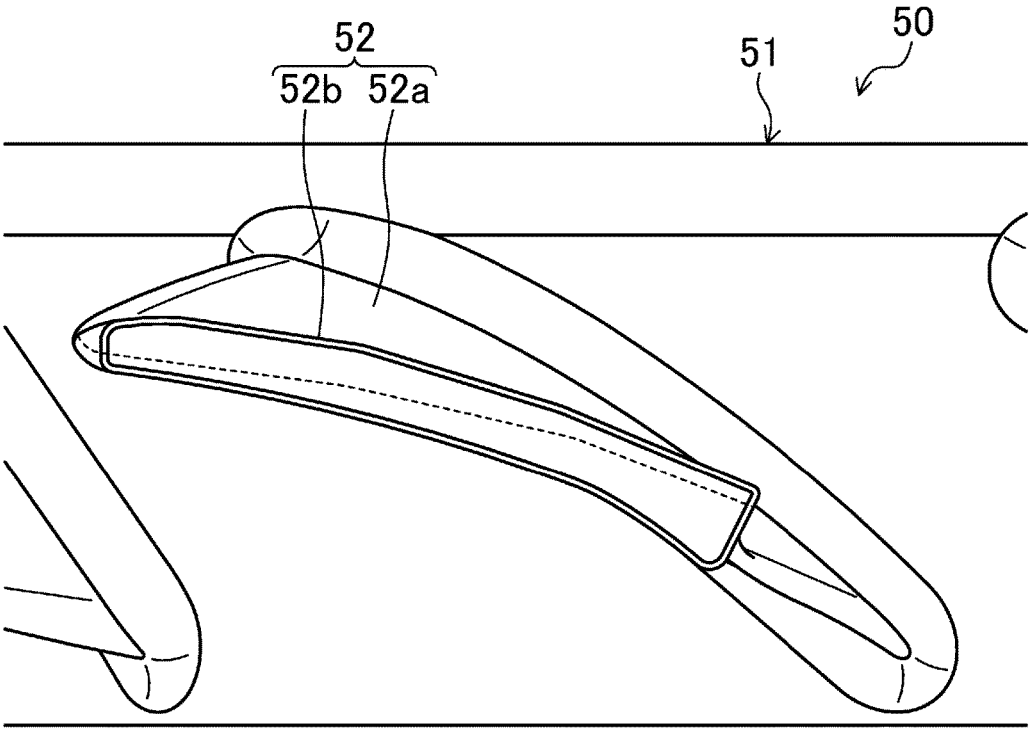
FIGS. 12A and 12B are partial side views illustrating a variation of a rotary blade.
Figure 12B:
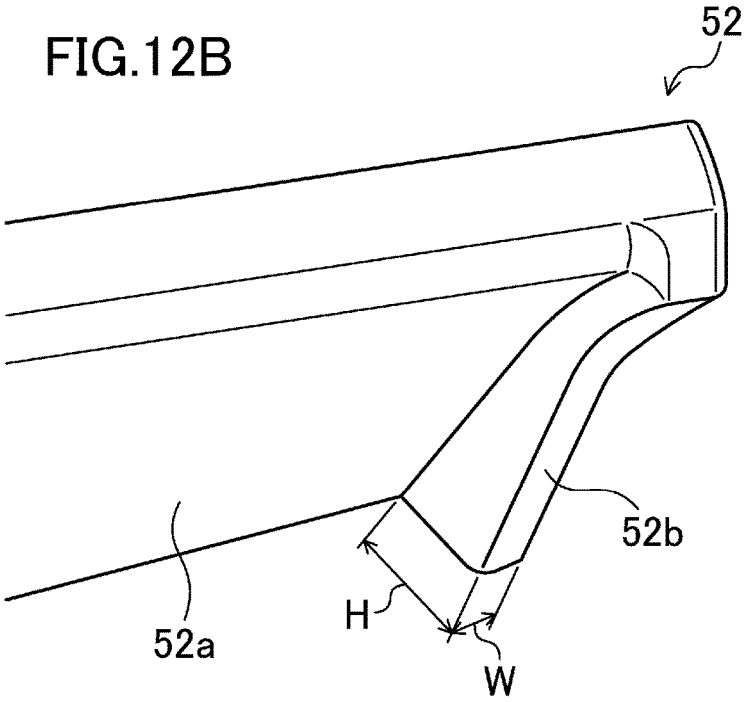

As shown in FIGS. 12A and 12B, the rib (52*b*) may be formed such that its height (H) increases from the leading edge side toward the rear edge side of the rotary blade body (52*a*). In this example, the rib (52*b*) is formed such that its width (W) remains the same from the leading edge side of the rotary blade body (52*a*) to the rear edge side.

Note that, the velocity of air, which travels toward the outer peripheral edge portion of the rotary blade (52), increases from the leading edge side toward the rear edge side of the outer peripheral edge portion of the rotary blade (52). Therefore, at the outer peripheral edge portion of the rotary blade (52), the risk of air flowing back from the pressure surface side to the suction surface side of the rotary blade (52) becomes higher from the leading edge side toward the rear edge side. Consequently, by forming the rib (52*b*) such that its height (H) increases from the leading edge side toward the rear edge side of the rotary blade body (52*a*), the risk of air flowing back from the pressure surface side to the suction surface side at the outer peripheral edge portion of the rotary blade (52) may be effectively reduced. In this way, the air blow efficiency of the propeller fan (50) may be effectively improved.

[Variation of Static Blade]

Figure 13:
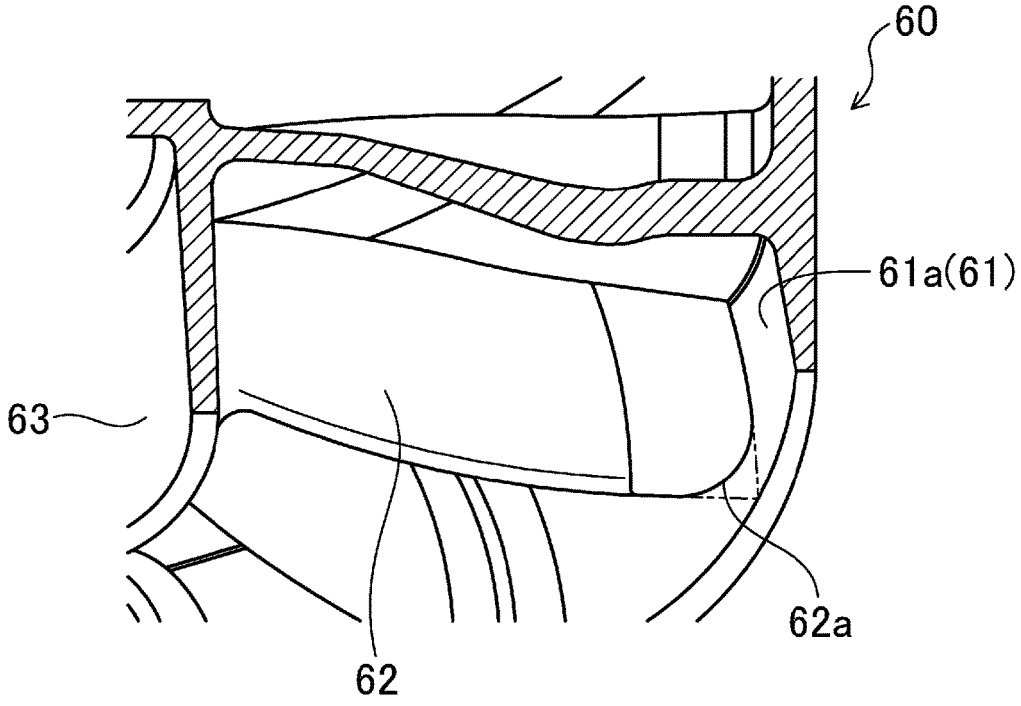
FIG. 13 is a partial perspective view illustrating a variation of a static blade.

As shown in FIG. 13, the static blade (62) may be formed such that its thickness (length in the circumferential direction) remains the same from the inner peripheral side along the outer peripheral side. Further, the notch (62*a*) may be formed so as to become deeper from the inner peripheral side of the static blade (62) toward the outer peripheral side. In this example, the notch (62*a*) has a base in the shape of a right-angled triangle with its right angle serving as rear edge side. Moreover, the hypotenuse of the notch (62*a*) gradually curves from the rear edge side toward the leading edge side of the static blade (62) as the hypotenuse proceeds from the inner peripheral side to the outer peripheral side, such that the hypotenuse is convex at the outward side of the static blade (62). Note that in FIG. 13 the contour of the outer peripheral side of the rear edge portion of the static blade (62) in the case where no notch (62*a*) is formed is shown in a phantom line (dot-dot-dash line).

[Other Embodiments]

In the example given in the above description, a rib (52*b*) is provided for each of the rotary blades (52) of the propeller fan (50). However, the propeller fan (50) may as well include a rotary blade (52) having no ribs (52*b*) formed thereon.

Further, in the example case, the notch (62*a*) is formed for each of the static blades of the fan housing (60). However, the fan housing (60) may as well include a static blade (62) with no notch (62*a*) formed thereon.

Moreover, the above embodiments may be combined appropriately. The above embodiment is a beneficial example in nature, and does not intend to limit the scope, applications, and use of the present disclosure.

INDUSTRIAL APPLICABILITY

As can be seen from the foregoing, the propeller fan is useful for a blower unit, or a different kind of air handler, including a refrigeration device, which cools the interior of a container.

DESCRIPTION OF REFERENCE CHARACTERS

1 Container Refrigeration Device (Refrigeration Device)
2 Container
10 Casing
20 Refrigeration Circuit
30 Exterior Blower Unit
40 Interior Blower Unit (Blower Unit)
50 Interior Propeller Fan (Propeller Fan)
51 Rotary Blade Hub
52 Rotary Blade
52*a* Rotary Blade Body
52*b* Rib
60 Interior Fan Housing (Fan Housing)
61 Housing Body
62 Static Blade
62*a* Notch
62*b* Corner
63 Static Blade Hub
70 Interior Fan Motor (Fan Motor)
80 Controller

The invention claimed is:

1. A propeller fan blowing air in an axial direction of a rotation axis, the propeller fan comprising:

a rotary blade hub driven in rotation about the rotation axis; and a rotary blade located at an outer periphery of the rotary blade hub, wherein the rotary blade includes a rotary blade body protruding from an outer peripheral surface of the rotary blade hub, and a rib formed on an outer peripheral edge portion of a pressure surface of the rotary blade body so as to extend along an outer peripheral edge of the rotary blade body, and the rib has a height increasing from a leading edge side toward a rear edge side of the rotary blade body in a whole of the outer peripheral edge of the rotary blade body.

2. The propeller fan of claim 1, wherein the rotary blade body has an outer peripheral surface of a cylindrical shape, and the rib has an outer peripheral surface of a cylindrical shape flush with the outer peripheral surface of the rotary blade body.

3. The propeller fan of claim 1, wherein the rib has an inner peripheral surface formed so as to stand upright with respect to the pressure surface of the rotary blade body.

4. A blower unit comprising:

a propeller fan sending air in an axial direction of a rotation axis; and a fan housing housing the propeller fan in a rotatable manner, wherein the fan housing is installed so as to enclose an outer periphery of the propeller fan and has a housing body allowing air sent by the propeller fan to an interior space of the housing body to pass through, and a static blade provided for an inner periphery of the housing body to be located at a leeward side of the propeller fan and straightening air blown out of the propeller fan, and the propeller fan is the propeller fan of claim 1.

5. The blower unit of claim 4, wherein the static blade has a notch formed on an outer peripheral side of a rear edge portion of the static blade.

6. The blower unit of claim 5, wherein the static blade has a chamfered corner adjacent to an inner peripheral side of the notch.

7. The blower unit of claim 5, wherein the notch is formed so as to become deeper from an inner peripheral side to an outer peripheral side of the static blade.

8. The blower unit of claim 5, wherein the housing body has a portion enclosing the outer periphery of the propeller fan formed integrally with a portion enclosing an outer periphery of the static blade.

9. The propeller fan of claim 2, wherein the rib has an inner peripheral surface formed so as to stand upright with respect to the pressure surface of the rotary blade body.

10. A blower unit comprising:

a propeller fan sending air in an axial direction of a rotation axis; and a fan housing housing the propeller fan in a rotatable manner, wherein the fan housing is installed so as to enclose an outer periphery of the propeller fan and has a housing body allowing air sent by the propeller fan to an interior space of the housing body to pass through, and a static blade provided for an inner periphery of the housing body to be located at a leeward side of the propeller fan and straightening air blown out of the propeller fan, and the propeller fan is the propeller fan of claim 2.

11. A blower unit comprising:

a propeller fan sending air in an axial direction of a rotation axis; and a fan housing housing the propeller fan in a rotatable manner, wherein the fan housing is installed so as to enclose an outer periphery of the propeller fan and has a housing body allowing air sent by the propeller fan to an interior space of the housing body to pass through, and a static blade provided for an inner periphery of the housing body to be located at a leeward side of the propeller fan and straightening air blown out of the propeller fan, and the propeller fan is the propeller fan of claim 3.

12. A blower unit comprising:

a propeller fan sending air in an axial direction of a rotation axis; and a fan housing housing the propeller fan in a rotatable manner, wherein the fan housing is installed so as to enclose an outer periphery of the propeller fan and has a housing body allowing air sent by the propeller fan to an interior space of the housing body to pass through, and a static blade provided for an inner periphery of the housing body to be located at a leeward side of the propeller fan and straightening air blown out of the propeller fan, and the propeller fan is the propeller fan of claim 9.

* * * * *